US005267394A

United States Patent [19]

Amano et al.

[11] Patent Number: 5,267,394

[45] Date of Patent: Dec. 7, 1993

[54] METHOD OF MANUFACTURING LONG AND NARROW ELECTRONIC PART

[75] Inventors: Toshio Amano; Yoshinobu Kishimoto; Fumiaki Tagashira; Hisayoshi Fujimoto; Shigeo Ota, all of Kyoto, Japan

[73] Assignee: Rohm Company, Limited, Kyoto, Japan

[21] Appl. No.: 873,218

[22] Filed: Apr. 24, 1992

[30] Foreign Application Priority Data

Apr. 26, 1991 [JP] Japan ..... 3-96879
Sep. 30, 1991 [JP] Japan ..... 3-250939

[51] Int. Cl.[5] ..... H05B 3/00

[52] U.S. Cl. ..... 29/611; 29/464; 156/295; 156/299

[58] Field of Search ..... 29/611, 464, 467; 156/295, 299, 312, 75

[56] References Cited

U.S. PATENT DOCUMENTS 4,999,077 3/1991 Drake et al. ..... 29/464

FOREIGN PATENT DOCUMENTS 59-36474 2/1984 Japan .
59-59345 4/1984 Japan .
60-31296 2/1985 Japan .
61-79677 4/1986 Japan .
1-175828 12/1989 Japan .

*Primary Examiner*—P. W. Echols

[57] ABSTRACT

A pair of holes are formed with a predetermined space therebetween on a long and narrow base plate. An adhesive is applied to the surface of the base plate. Head substrates each having a row of thermal resistors on the surface thereof are placed on the adhesive on the base plate such that the joint of the head substrates is positioned between the pair of holes of the base plate. The adhesive is hardened in the state in which the head substrates are pushed upward by thrusting means inserted into a pair of holes while the base plate is supported from below and the head substrates is pressed from above. The base plate is bonded to a radiating plate by an adhesive only at the central portion. Thus, there is no difference in level at the joint of the head substrates, and even when the radiating plate expands due to heat, the base plate is not deformed.

6 Claims, 8 Drawing Sheets

METHOD OF MANUFACTURING LONG AND NARROW ELECTRONIC PART

BACKGROUND OF THE INVENTION

1. Field of the Invention

The present invention relates to a method of manufacturing a long and narrow electronic part such as a thermal head which can be used for facsimile equipment, printers, plotters or the like, a print head such as an LED head, and an image sensor for reading, and a thermal head produced by this method.

2. Description of the Related Art

A long and narrow electronic part, such as a print head or an image sensor for reading, is obtained by connecting or combining a plurality of electronic parts with each other. For example, in a thermal head used for a thermal printer, a plurality of head substrates each provided with a thermal resistor are connected to each other so as to have a length which corresponds to the printing width.

In such a long and narrow electronic part, however, there is often a difference in level at joint portions, and various problems are produced. For example, in the case of a thermal head, printing is carried out by feeding paper (e.g., heat-sensitive paper) between the thermal resistor and a platen, and bringing the paper into contact with the thermal resistor. At this time, if there is a difference in level at the joints of head substrates, the contact between the thermal resistor and the paper is not uniform, thereby lowering the printing quality.

Various methods of eliminating the difference in level at the joint portions of a long and narrow electronic part have been proposed.

For example, Japanese Patent Laid-Open No. Sho 59-36474 discloses a thermal head such as that shown in FIG. 1. Head substrates 130*a* and 130*b* are fixed on support plates 131*a* and 131*b*, respectively, and the support plates 131*a* and 131*b* are fixed on a common holding base plate 132. The support plates 131*a* and 131*b* are elevated or lowered by vertically moving screws 134 driven into threaded holes 133, thereby adjusting the heights of the head substrates 130*a*, 130*b* so as to eliminate the difference in level. In order to allow such adjustment, gaps a and b are provided between the head substrate 130*a* and 130*b*, and between the support plates 131*a* and 131*b*, respectively.

In this conventional thermal head, however, since the gaps a and b are provided, if the thermal head is bent as a whole, the end portions of the head substrates 130*a* and 130*b* hit against each other and the joint is broken or chipped.

Japanese Utility Model Laid-Open No. Hei 1-175828 discloses a thermal head similar to the above-described one. In this thermal head, a slit is formed on the support plate 131 so as to allow vertical movement of the support plate 131. However, this thermal head also involves a similar problem.

Japanese Patent Laid-Open No. 60-31296 discloses a method of eliminating a difference in level at the joint between head substrates by providing a recessed portion below the joint so as to bend the head substrates when the head is pressed against the platen. This method is disadvantageous in that it is difficult to set the hardness of the platen and to select the material of the platen.

SUMMARY OF THE INVENTION

Accordingly, it is an object of the present invention to eliminate the above-described problems in the related art and to provide a method of manufacturing a thermal head which does not produce a difference in level at the joints of head substrates, and a thermal head which is manufactured by this method and which has no difference in level at the joints of head substrates.

It is another object of the present invention to provide a thermal head in which the base plate is not warped even by the thermal expansion of the radiating plate.

To achieve this aim, the present invention provides a method of manufacturing an electronic part comprising the steps of:

(a) applying an adhesive to a base plate provided with plural pairs of holes with a predetermined space therebetween;

(b) placing a plurality of long and narrow head substrates on the adhesive such that each joint of the head substrates is positioned between each pair of holes; and (c) hardening the adhesive in the state in which the head substrates are pushed upward by thrusting means inserted into a pair of holes while the base plate is supported from below and the head substrates are pressed from above.

Since the head substrates are bonded to the base plate by the adhesive in the state in which the head substrates are pressed against a stay provided thereabove, a difference in level is not produced on the upper surface of the head substrates.

Each of the head substrates has a row of thermal resistors in the longitudinal direction thereof. These head substrates are preferably incorporated into a thermal head.

The base plate is preferably composed of a ceramic material and the adhesive is preferably a silicon adhesive.

In the case of producing a thermal head by using these head substrates, the base plate is bonded to a radiating plate. Preferably, only the central part of the base plate is bonded to the radiating plate so as to prevent the thermal head from warping due to a difference in thermal expansion coefficient between the radiating plate and the base plate.

The present invention also provides a thermal head comprising:

a plurality of head substrates having a row of thermal resistors on the surface thereof; and a base plate to which the plurality of head substrates are fixed by an adhesive;

the base plate being provided with plural pairs of holes with a predetermined space therebetween;

the plurality of head substrates being arranged on the base plate such that each joint of the head substrates is positioned between each pair of holes;

the head substrates being bonded to the base plate by an adhesive which is hardened in the state in which the head substrates are pushed upward by thrusting means inserted into a pair of holes while the base plate is supported from below and the head substrates are pressed from above so that each joint of the head substrates has substantially no difference in level.

Each pair of holes are preferably provided in the base plate at a position shifted from under the row of thermal resistors. This arrangement of holes enables the base plate to uniformly radiate.

It is also preferable that a wiring board for supplying current to the rows of thermal resistors on the head substrates is bonded by the adhesive to the base plate together with the head substrates.

The above and other objects, features and advantages of the present invention will become clear from the following description of the preferred embodiment thereof, taken in conjunction with the accompanying drawings.

DESCRIPTION OF THE PREFERRED EMBODIMENTS

Example of a method of manufacturing an electronic part

An embodiment of a method of manufacturing a long and narrow electronic part according to the present invention will be explained hereinunder.

Figure 1:
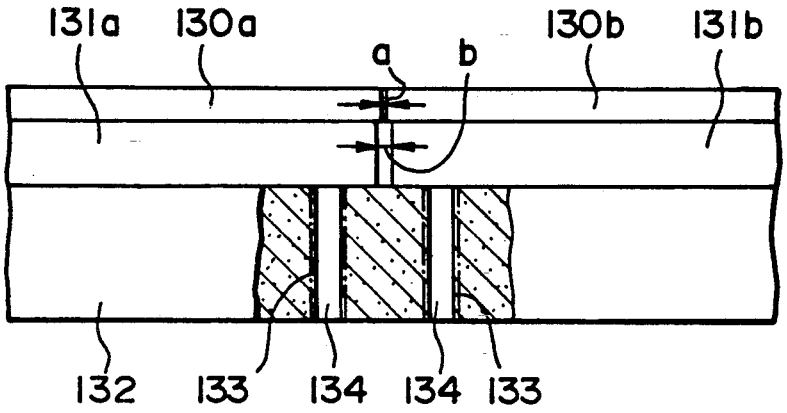
FIG. 1 PRIOR ART
FIG. 1 explains a conventional method of matching the heights of electronic part members.
Figure 2:
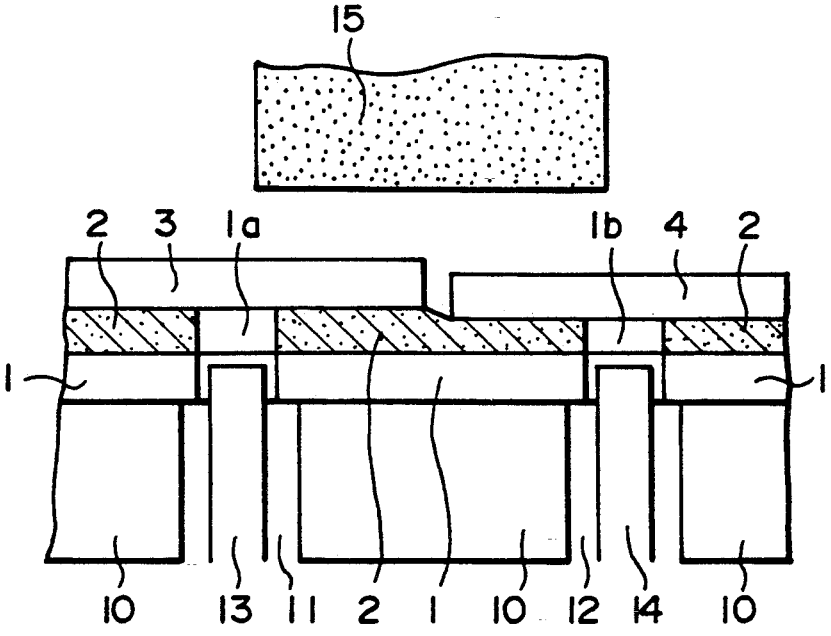
FIG. 2 shows a first procedure of an embodiment of a method of manufacturing a long and narrow electronic part according to the present invention.

FIGS. 2 to 5 show the procedures of an embodiment of a manufacturing method according to the present invention which is applied to the production of a thermal head. In FIG. 2, a pair of circular holes 1*a*, 1*b* are formed in a base plate 1 in the longitudinal direction with a predetermined space therebetween in correspondence with the position of the joint of head substrates 3, 4. After an adhesive 2 is applied to the entire surface of the base plate 1, the head substrates 3, 4 are placed on the adhesive 2 such that the joint is positioned between the circular holes 1*a* and 1*b* of the base plate 1. In this embodiment, the head substrate 3 is at a higher level than the head substrate 4 at this point in time. In other words, there is a difference in level at the joint of the substrates 3 and 4.

The base plate 1 having this structure is placed on an appropriate base plate fixing table 10 such that the circular holes 1*a*, 1*b* of the base plate 1 are positioned right above the circular holes 11, 12 formed in the fixing table 10. As shown in FIG. 2, the circular holes 11, 12 have a slightly larger diameter than the circular holes 1*a*, 1*b*. Micrometer heads 13, 14 are inserted into the circular holes 11 and 12, respectively, as thrusting means, and a stay 15 is disposed above the joint of the head substrates 3, 4.

Figure 3:
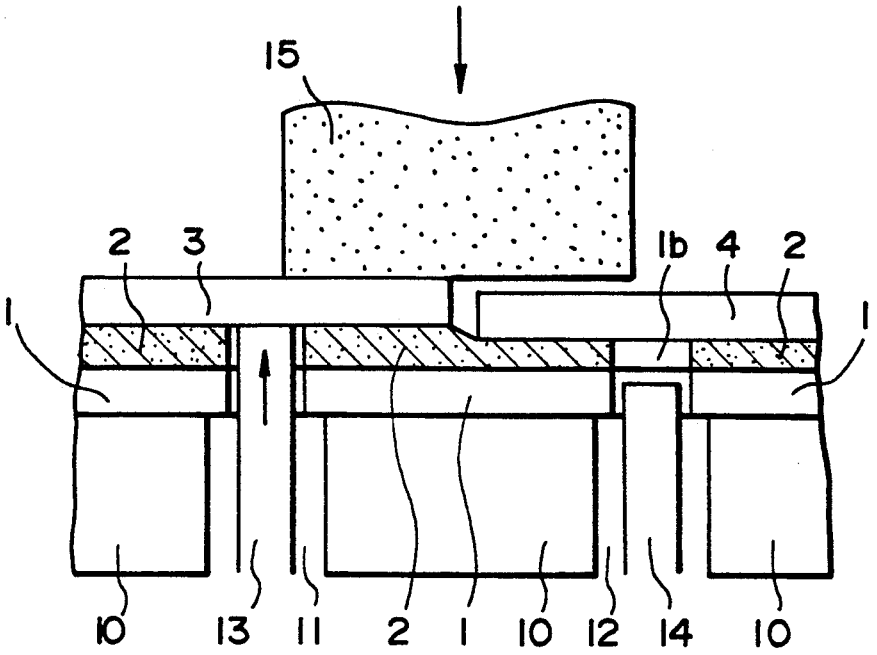
FIG. 3 shows a second procedure of the embodiment shown in FIG. 2.

As shown in FIG. 3, after the base plate 1 is supported by the fixing table 10, the stay 15 is pushed downward until the stay 15 lightly presses the surfaces of the head substrates 3, 4. The micrometer head 13 is then pushed upward so as to strongly press the head substrate 3 against the stay 15. The position of the head substrate 3 is fixed at this point.

Figure 4:
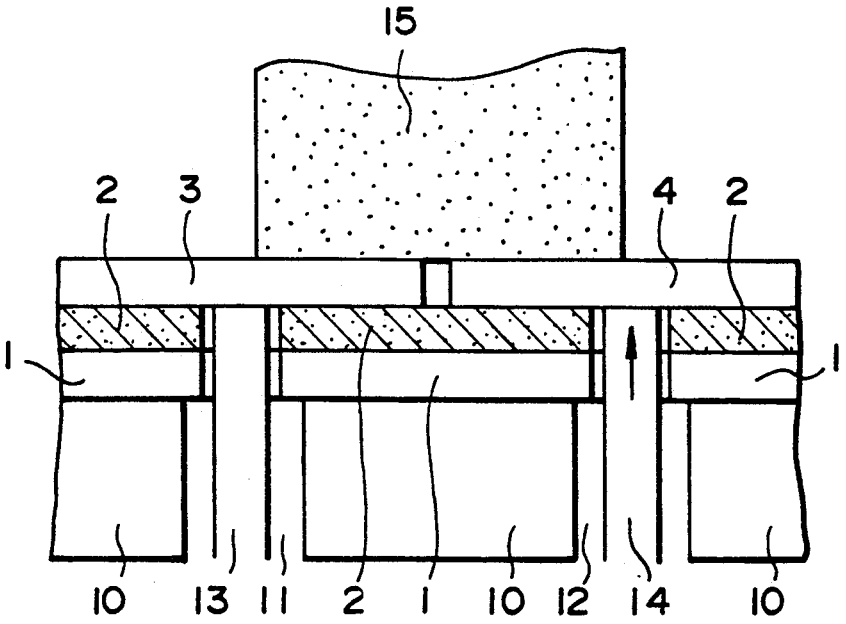
FIG. 4 shows a third procedure of the embodiment shown in FIG. 2.

Thereafter, the micrometer head 14 is pushed upward so as to strongly press the head substrate 4 against the stay 15, as shown in FIG. 4. At this time, the micrometer head 14 is operated while the difference in level at the joint of the head substrates 3, 4 is measured by a displacement measuring machine so that the difference in level is within at least 3 μm. In this state, the adhesive 2 is completely hardened. By this method, the difference in level at the joint of the head substrates 3, 4 is eliminated to a degree which becomes negligible in practical use.

Figure 5:
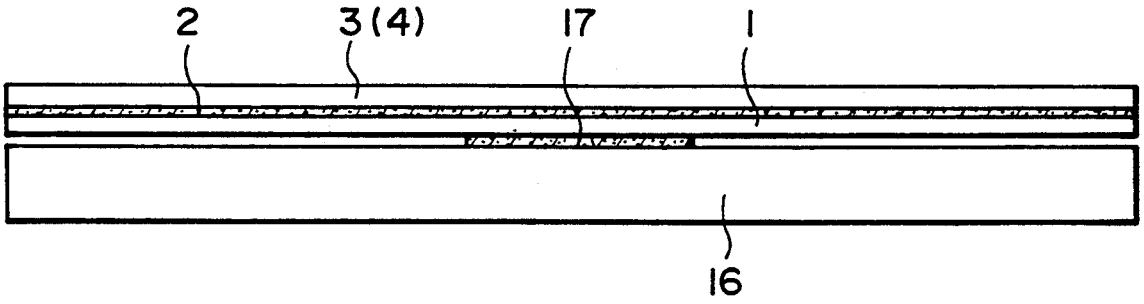
FIG. 5 shows a thermal head in the bonded state which is manufactured by the embodiment shown in FIGS. 2 to 4.

The assembly of the base plate 1 and the head substrates 3, 4 is incorporated into a thermal head by fixing the structure to a radiating plate 16 by an adhesive, as shown in FIG. 5. An adhesive 17 is placed in the vicinity of the central portion of the radiating plate 16. In this state, the assembly of the base plate 1 and the head substrates 3, 4 is pressed against the adhesive 17, and the adhesive 17 is hardened.

The adhesives 2, 17 are preferably silicon adhesives having a high thermal conductivity.

Figure 6A:
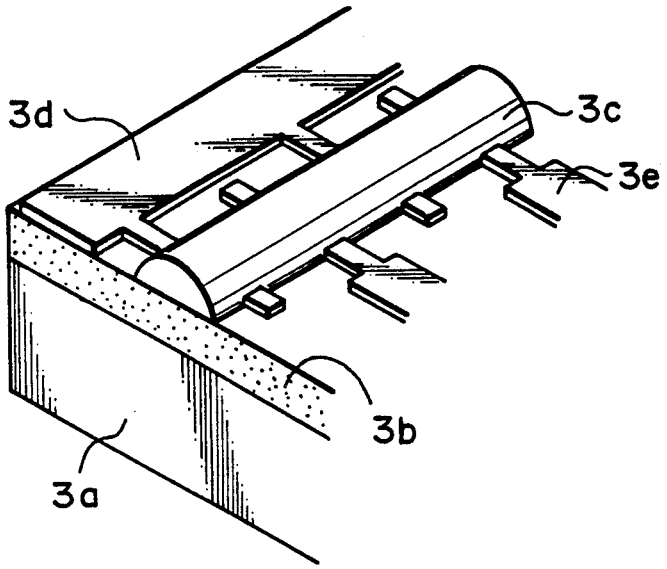
FIG. 6A shows the structure of a row of thermal resistors on a thick-film head substrate.
Figure 6B:
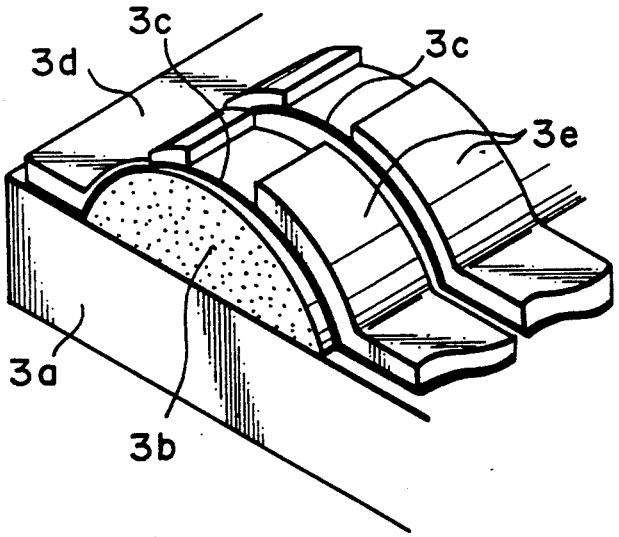
FIG. 6B the structure of a row of thermal resistors on a thin-film head substrate.

FIG. 6A shows the structure of the thick-film head substrate 3 (4), and FIG. 6B shows the structure of the thin-film head substrate 3 (4). The thick-film head substrate 3 has a glaze layer 3*b* which does not contain lead, which is non alkali and which has a high softening temperature on a substrate 3*a* composed of an alumina ceramic material. A linear resistor 3*c*, and a common lead 3*d* and individual leads 3*e* for supplying a current to the resistor 3*c* are formed on the glaze layer 3*b*.

By selecting a specific appropriate individual lead 3*e* and applying a voltage between the selected individual lead 3*e* and the common lead 3*d*, the corresponding portion of the resistor 3*c* is heated.

On the other hand, in the thin-film head substrate 3, the glaze layer 3*b* is linear. Resistors 3*c* are formed in such a manner as to cover the substrate 3*a* and the glaze layer 3*b*. The common lead 3*d* is opposed to the individual leads 3*e* with a space therebetween on the glaze layer 3*b*. By selecting a specific individual lead 3*e* and applying a voltage between the selected individual lead 3*e* and the common lead 3*d*, the resistor 3*c* at the corresponding portion is heated.

Figure 7:
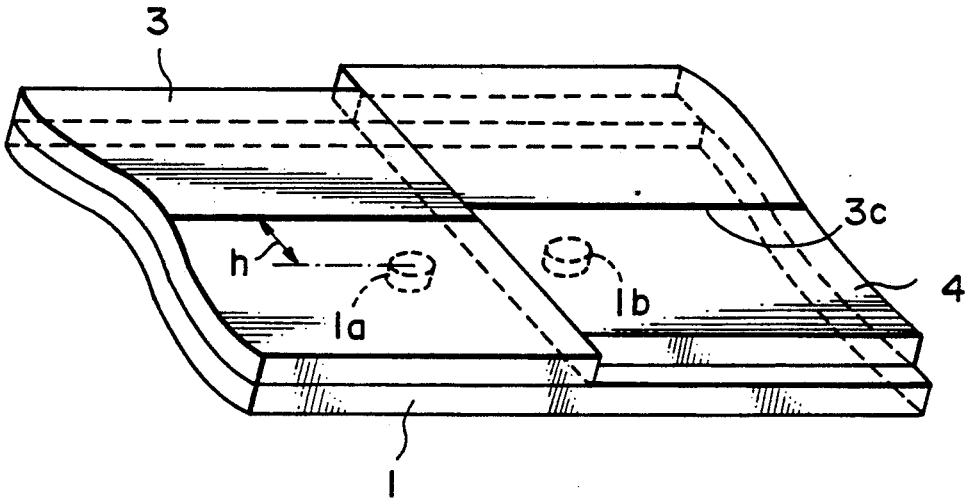
FIG. 7 shows head substrates in the bonded state.

FIG. 7 is a schematic perspective view of the joint portion of the assembly of the head substrates 3, 4 and the base plate 1. As is clear from FIG. 7, according to the embodiment of the manufacturing method of the present invention, there is no difference in level on the upper surfaces of the head substrates 3 and 4. The positions of the pair of holes 1*a*, 1*b* formed in the vicinity of the joint of the base plate 1 are not immediately under resistors 3*c* which constitute the row of thermal resistors but are deviated therefrom by a predetermined distance (h). Therefore, the radiation from the resistor 3*c* is uniform over the entire part. If the holes 1*a*, 1*b* are positioned immediately under the resistor 3c, uniform radiation is impossible.

Figure 8:
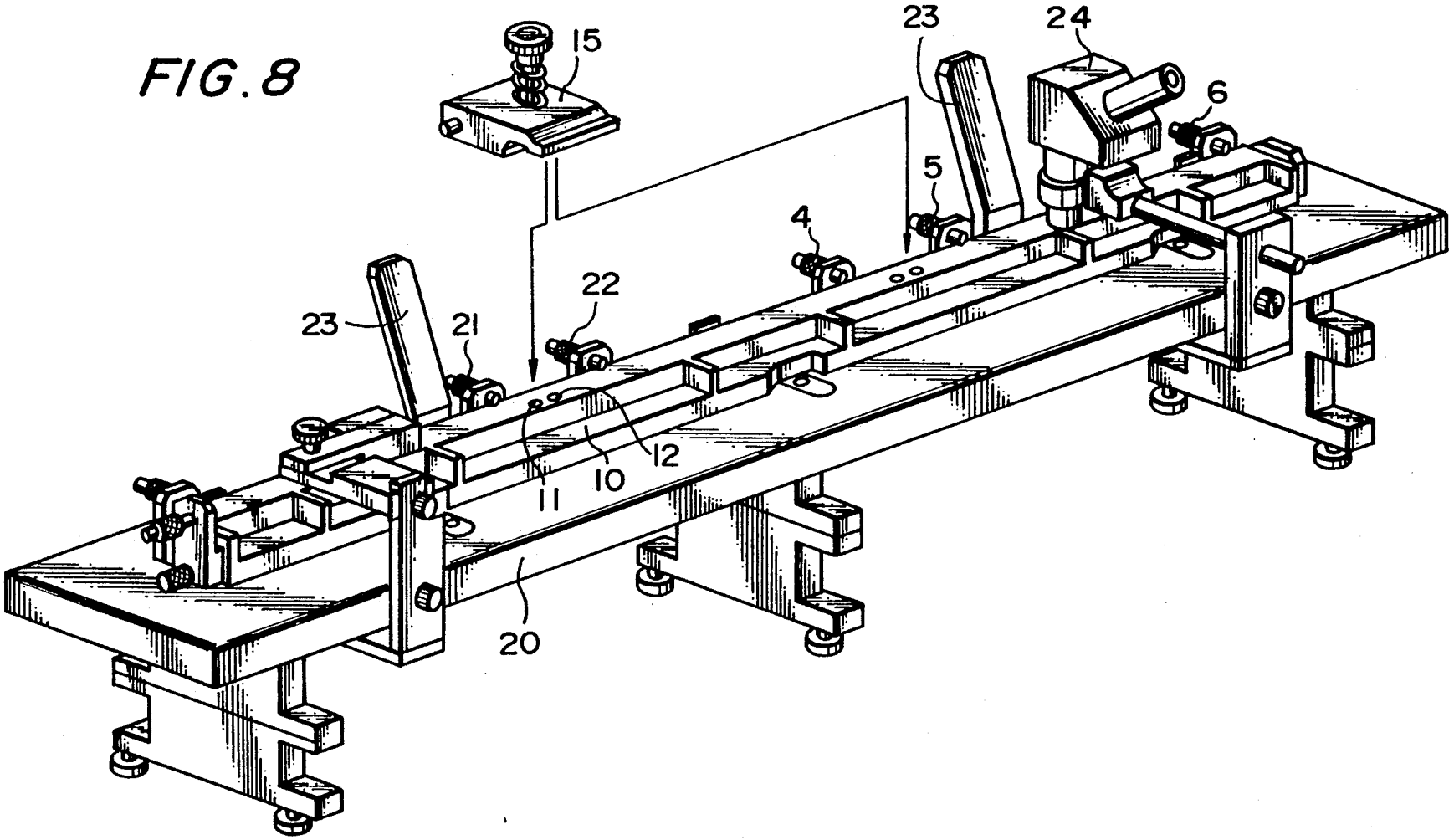
FIG. 8 shows the structure of a jig for bonding head substrates.

FIG. 8 schematically shows the structure of a jig used for bonding the head substrates 3, 4 to the base plate 1. The fixing table 10 is placed on a frame 20. Micrometer head drivers 21, 22 for vertically moving the micrometer heads 13 and 14, respectively, are provided in the vicinity of the holes 11, 12 of the fixing table 10. The stay 15 which is vertically movable and which has a flat undersurface is attached to the portion which corresponds to the holes 11, 12. In this way, it is possible to push the micrometer heads 13, 14 upward so as to press the head substrates 3, 4 against the stay 15 at the time of bonding the base plate 1 to the head substrates 3, 4.

In this embodiment, grips 23 are provided on the fixing table 10 so as to make it easy to carry the fixing table 10. The fixing table 10 is carried into an oven in the state in which the head substrates 3, 4 are pressed against the stay 15, and the assembly of the base plate 1 and the head substrates 4 is heated for a predetermined time. For example, in the case of using a thermoset resin as the adhesive 2, such a heat treatment is preferable. As an example of the thermoset resin, an epoxy resin will be cited.

A laser measuring machine 24 observes the state of the difference in level at the joint of the head substrates 3, 4. It is possible to control the movement of the micrometer heads 13, 14 in accordance with the result of the measurement.

As described above, the base plate 1 is bonded to the radiating plate 16 only at appropriate points in the vicinity of the central portion in the longitudinal direction. The radiating heat 16 can therefore freely extend in the other portions. A metal material is generally used for the radiating plate 16, so that the thermal expansion coefficient of the radiating plate 16 is larger than that of the base plate 1 which is composed of a ceramic material. Consequently, if the entire surfaces of the radiating plate 16 and the base plate 1 are bonded to each other, warping is caused due to the bimetal effect brought about by the difference in thermal expansion coefficient. However, according to the structure of this embodiment, it is possible to reduce the bimetal effect as much as possible. In addition, if a silicon adhesive which has a high thermal conductivity is used as the adhesive 17, it is possible to maintain the heat dissipation from the base plate 1 at a predetermined value.

In the method of the present invention, the base plate 1 is bonded to the whole of head substrates 3, 4 by the adhesive 2. Since the adhesive strength between the base plate 1 and the head substrates 3, 4 is high, the tensile force applied to the base plate 1 is absorbed. Therefore, when the assembly of the base plate 1 and the head substrates 3, 4 is fixed to the radiating plate 16, the thermal expansion (extension) of the radiating heat 16 does not influence the head substrates 3, 4. As a result, a problem caused by temperature change such as the enlargement of the joint of the head substrates 3, 4 and the warping of the head substrates 3, 4 is not produced. In addition, since a cheap ceramic material can be used for the base plate 1 and any special step, except for forming a pair of holes 1a, 1b having an appropriate size in the base plate 1, is unnecessary, the manufacturing cost is low.

The thrusting means used in the method of the present invention is not specified so long as it can push the head substrate upward from the hole of the base plate. For example, it may be an adjust screw as in the related art, a micrometer head, or a mere rod-like member.

Example of the structure of a thermal head

Figure 9:
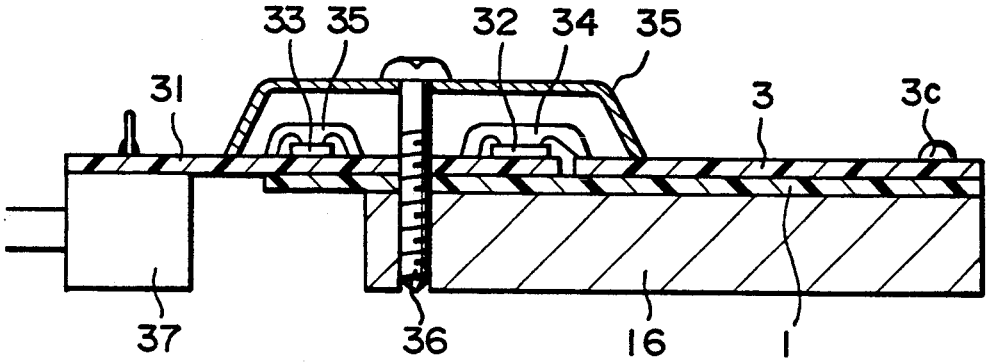
FIG. 9 is a sectional view of the structure of an embodiment of a thermal head according to the present invention.

FIG. 9 is a cross sectional view of an embodiment of a thermal head according to the present invention. In FIG. 9, the base plate 1, composed of a ceramic material, is placed as a common base on the aluminum radiating plate 16, and the ceramic head substrate 3 and a wiring board 31 are arranged on the upper surface of the base plate 1. A row of thermal resistors 3c is formed on the head substrate 3 in the longitudinal direction, as therefore shown in cross section in the diagram. A common lead pattern (not shown) and individual lead patterns (not shown) for energizing the row of thermal resistors 3c are formed on the head substrate 3. A driver IC 32 for driving the thermal resistors 3c and a printing control IC 33 are mounted on the wiring board 31, and a wiring circuit pattern (not shown) is formed on the wiring board 31. The driver IC 32 and the printing control IC 33 are connected to the pads of the electrode patterns and the circuit pattern by wire bonding and sealed by resins 34 and 35, respectively. The upper surfaces of the driver IC 32 and the printing control IC 33 are covered with a cover 35 which is attached to the radiating plate 16 by a screw 36. The reference numeral 37 represents a connector for external connection.

The radiating plate 16 and the base plate 1 are bonded to each other at the central portion in the longitudinal direction by the adhesive 17 having a high thermal conductivity such as a silicon adhesive, as shown in FIG. 5. Since only the central portion of the radiating plate 16 is bonded, even if the radiating plate 16 is contracted or expanded due to temperature change, the contraction or expansion does not influence the ceramic base plate 1, thereby preventing the head substrate 4 from warping due to the temperature change.

The base plate 1 and the head substrate 3 are entirely bonded together by the silicon adhesive 2 having a high thermal conductivity. It is therefore possible to secure the heat dissipation from the head substrate 3.

Figure 10:
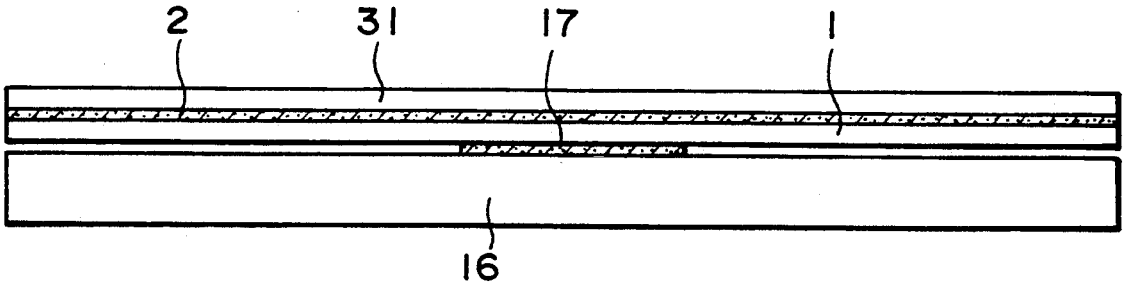
FIG. 10 is an explanatory view of the thermal head in the bonded state.

The base plate 1 and the wiring board 31 are entirely bonded together by the adhesive 2, as shown in FIG. 10. It is possible to use a self adhesive in place of the adhesive 2 and bond them over their entire surfaces by the self adhesive. The wiring board 31 preferably has a linear expansion coefficient approximate to that of the head substrate 3. Since the base plate 1 and the wiring board 31 are completely bonded to each other and the wiring board 31 is on the base plate 1 which is common to the head substrate 3, the relative position of the wiring board 31 and the head substrate 3 is unlikely to deviate. This is convenient for bridging the bonding wire for the driver IC 32 to the head substrate 3.

Although the driver IC 32 is mounted on the wiring board 31 in this embodiment, the driver IC 32 may be mounted on the head substrate 3.

The ceramic plate as the base plate 1 may be replaced by a plate of another material having a similar linear expansion coefficient.

The thermal head of this embodiment is incorporated into the printing portion of an electronic apparatus such as a facsimile, printer or plotter.

Another example of the structure of a thermal head

Figure 11:
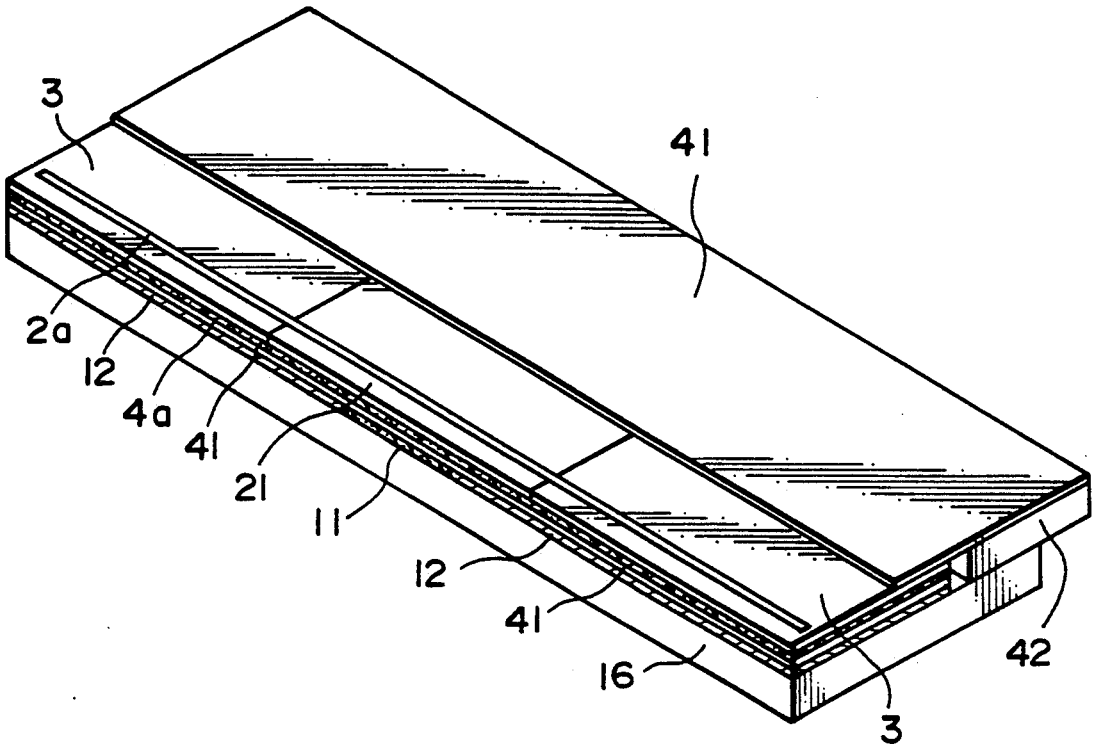
FIG. 11 is a perspective view of the structure of another embodiment of a thermal head according to the present invention.

FIG. 11 is a perspective view of another embodiment of a thermal head according to the present invention.

The thermal head is composed of the radiating plate 16, the head substrate 3 provided with the row of thermal resistors 2*a*, and an auxiliary plate 42 provided with a flexible substrate 41. A plurality of driver IC's are mounted on the head substrate 3, and a common electrode pattern, individual electrode patterns and other lead patterns are formed on the head substrate 3. The head substrate 3 and the auxiliary plate 42 are arranged on the upper surface of the radiating plate 16, and the end portions of the flexible substrate 41 are superimposed on the electrodes on the base plate 1. In this state, the head substrate 3 and the auxiliary plate 42 are pressed against and fixed to the radiating plate 16 from above by a presser cover. As the head substrate 3, a plurality of short head substrates 3 are arranged in series. The plurality of head substrates 3 are bonded to the radiating plate 16 by adhesion through the base plate 1.

Figure 12:
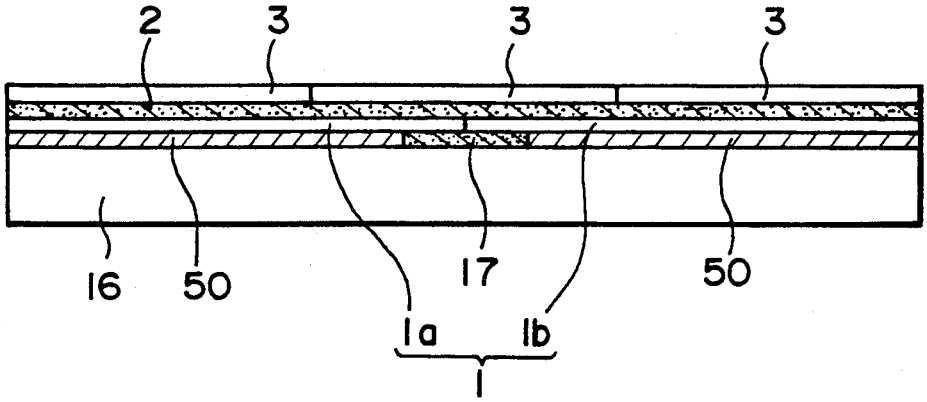
FIG. 12 is an explanatory view of the structure of the main part of the embodiment shown in FIG. 11.

In this embodiment, the adhesive 17 is applied to a predetermined area of the upper surface of the long and narrow radiating plate 16, and a silicon compound 50 is applied to both sides of the adhesive 17, as shown in FIG. 12. Two ceramic base plates 1*a*, 1*b* (each having a length of ½ of the length of the radiating plate 16) are used as the base plate 1 in this embodiment. The two base plates 1*a*, 1*b* are disposed on the radiating plate 16 such that the abutting surfaces of the two base plates 1*a*, 1*b* are at the central portion of the adhesive 17, and the base plates 1*a*, 1*b* are bonded to the radiating plate 16 by the adhesive 17. In other words, the radiating plate 16 and the ceramic base plates 1*a*, 1*b* are bonded to each other by the adhesive only at a part. Thereafter, the adhesive is applied to the entire part of the upper surface of the ceramic base plate 1*a*, 1*b* so as to bond the ceramic base plate 1 to the plurality of (3, in this embodiment) ceramic head substrates 3 by the adhesive 2. In other words, the base plate 1 and the short ceramic substrates 3' are fixed to each other completely.

In the thermal head having the above-described structure, the plurality of short ceramic head substrates 3 are bonded to the radiating plate 16 not directly but through the ceramic base plates 1*a*, 1*b*. The base plates 1*a*, 1*b* are bonded to the radiating plate not over their entire surface but at a part thereof. According to this structure, when the radiating plate 16 expands (extends) due to heat, the tensile force is applied to the base plates 1*a*, 1*b* which do not expand due to heat, but the tensile force is small because the base plates 1*a*, 1*b* and the radiating plate 16 are bonded to each other only at a part (adhesion area is small). On the other hand, the base plates 1*a*, 1*b* are completely bonded to the head substrates 3. Therefore, the adhesive strength between the base plates 1*a*, 1*b* and the head substrates 3 is high, so that the small tensile strength applied to the base plates 1*a*, 1*b* is absorbed. The thermal expansion (extension) of the radiating plate 16 therefore exerts no influence on the plurality of short head substrates 3, so that no gap is caused between the rows of thermal resistors 3*c* of the head substrates 3, thereby precluding the fear of deterioration of the printing quality.

It goes without saying that although the two ceramic base plates 1*a*, 1*b* are used in this embodiment, a single long and narrow base plate may be used.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A method of manufacturing an electronic part comprising the steps of:

(a) applying an adhesive to a base plate provided with a pair of holes with a predetermined space therebetween;

(b) placing a plurality of long and narrow head substrates on said adhesive such that a joint of said head substrates is positioned between said pair of holes; and (c) hardening said adhesive in the state in which said head substrates are pushed upward by thrusting means inserted into said pair of holes while said base plate is supported from below and said head substrates are pressed from above.

2. A method according to claim 1, wherein each of said head substrates has a row of thermal resistors in the longitudinal direction thereof.

3. A method according to claim 2, wherein said base plate is composed of a ceramic material.

4. A method according to claim 3, wherein said adhesive is a silicon adhesive.

5. A method according to claim 1, wherein said base plate with said plurality of head substrates bonded thereto by hardening said adhesive is bonded to a radiating plate by another adhesive.

6. A method according to claim 5, wherein only the central portion of said base plate is bonded to said radiating plate by said another adhesive.

* * * * *